US008517164B2

(12) United States Patent
Zampollo

(10) Patent No.: US 8,517,164 B2
(45) Date of Patent: Aug. 27, 2013

(54) SYSTEM FOR BATCHING AND EXPELLING STACKS CONSISTING OF A PREDETERMINED NUMBER OF CLIPS OF DISPOSABLE WIPES FROM A MAIN PRODUCTION LINE

(75) Inventor: Fabio Zampollo, Crema (IT)

(73) Assignee: Teknoweb Srl, Palazzo Pignano (CR) (IT)

( * ) Notice: Subject to any disclaimer, the term of this patent is extended or adjusted under 35 U.S.C. 154(b) by 107 days.

(21) Appl. No.: 13/379,355

(22) PCT Filed: Jun. 21, 2010

(86) PCT No.: PCT/IB2010/001497

§ 371 (c)(1),
(2), (4) Date: Dec. 20, 2011

(87) PCT Pub. No.: WO2010/150070

PCT Pub. Date: Dec. 29, 2010

(65) Prior Publication Data

US 2012/0103758 A1 May 3, 2012

(30) Foreign Application Priority Data

Jun. 22, 2009 (IT) ..... CR2009A0025

(51) Int. Cl.
*B65H 33/16* (2006.01)

(52) U.S. Cl.
USPC .... 198/418.6; 53/447; 414/790.3; 414/790.6; 414/790.9; 83/29; 83/86; 83/155.1

(58) Field of Classification Search
USPC ..... 198/418.6; 53/447; 414/789.9, 414/790.3, 790.6, 790.9; 83/29, 84, 86, 94, 83/155, 155.1
See application file for complete search history.

(56) References Cited

U.S. PATENT DOCUMENTS

| | | | | |
|---|---|---|---|---|
| 5,328,323 | A | 7/1994 | Molison | |
| 5,450,941 | A * | 9/1995 | Loewenthal | 198/418.5 |
| 5,476,361 | A * | 12/1995 | Uno | 414/790.3 |

(Continued)

FOREIGN PATENT DOCUMENTS

| | | | |
|---|---|---|---|
| EP | 0 076 939 | A1 | 4/1983 |
| EP | 0 611 720 | A1 | 8/1994 |
| GB | 1 445 913 | A | 8/1976 |
| GB | 2 157 270 | A | 10/1985 |

OTHER PUBLICATIONS

International Search Report, dated Sep. 22, 2010, from corresponding PCT application.

*Primary Examiner* — Mark A Deuble
(74) *Attorney, Agent, or Firm* — Young & Thompson

(57) ABSTRACT

Improved system for batching and expelling first and second stacks (10, 20) consisting of a predetermined number of clips (3) of disposable wipes from a main production line (S, 5), including at least a first grouping device (100, 200) that counts the clips (3) and transfers the stacks (10, 20) from the main production line (S, 5) to a first diverted conveyor line (A, 6) parallel to the main one, characterized in that it includes at least a second grouping device (100, 200), placed downstream from the first one, which counts the clips (3) and transfers the stacks (10, 20) from the main production line (S, 5) to a second diverted conveyor line (B, 7), parallel to the main line (S, 5), in which the first diverted conveyor line (A, 6) develops at a level lower than the second diverted conveyor line (B, 7).

16 Claims, 3 Drawing Sheets

(56) References Cited

U.S. PATENT DOCUMENTS

| | | | | |
|---|---|---|---|---|
| 5,730,695 | A * | 3/1998 | Hauschild et al. | 493/416 |
| 6,055,896 | A | 5/2000 | Molison | |
| 6,098,782 | A * | 8/2000 | Hardage et al. | 198/403 |
| 7,413,070 | B2 * | 8/2008 | Mayer | 198/431 |
| 8,056,704 | B2 * | 11/2011 | Christ | 198/617 |
| 2006/0070353 | A1 * | 4/2006 | Van Dam | 53/447 |
| 2006/0073007 | A1 * | 4/2006 | De Matteis | 414/789.9 |

* cited by examiner

SYSTEM FOR BATCHING AND EXPELLING STACKS CONSISTING OF A PREDETERMINED NUMBER OF CLIPS OF DISPOSABLE WIPES FROM A MAIN PRODUCTION LINE

The invention relates to the field of lines for producing and packaging disposable wipes, either wet or not, into stacks.

More in detail, the invention relates to an improved system, which operates at high speed, for batching and expelling stacks consisting of a predetermined number of clips of disposable wipes from a main production line.

According to the prior art, the lines for producing and packaging disposable wipes into stacks substantially comprise an initial zone for unwinding paper rolls for making a multilayer tape (or bar) obtained by overlapping and folding various strips of paper; an intermediate zone for cutting the bar so as to make clips of wipes folded on each other; a zone for counting and expelling the groups for making stacks consisting of a predetermined number of clips of wipes and a final zone for packaging said stacks.

All the movement and synchronism operations are managed by special electronic control units for the electromechanical members.

It is known to use two main types of grouping devices for counting and expelling the stacks consisting of predetermined clips of wipes from the production line.

Figure 1:
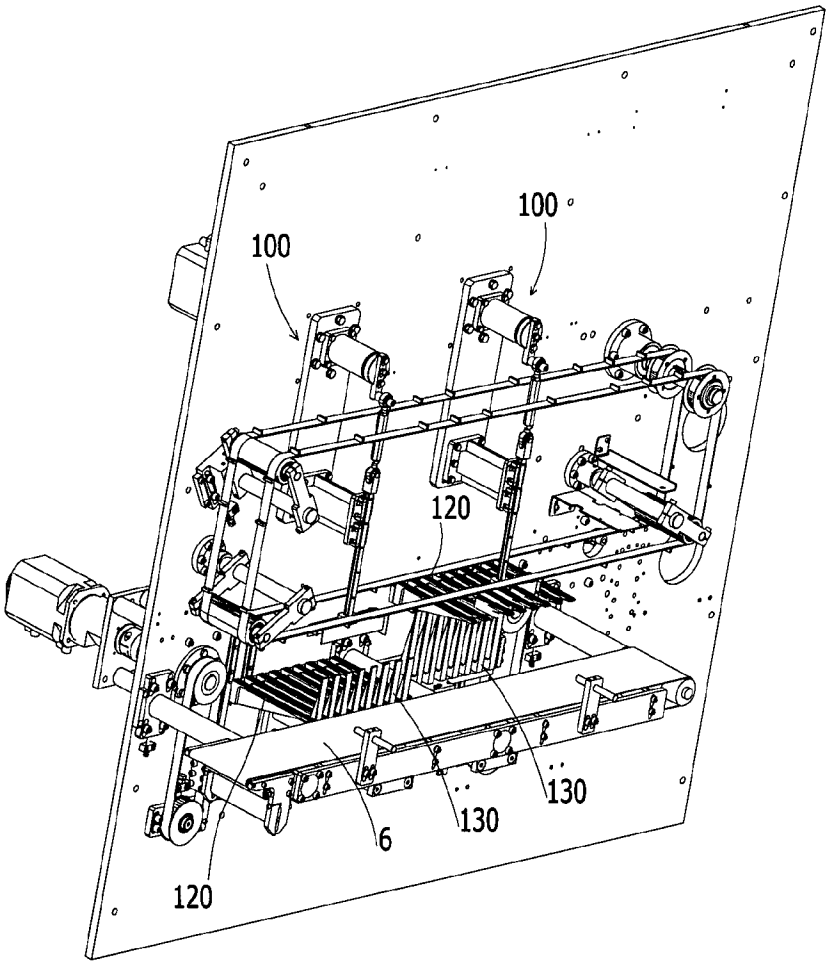
Fig. 1 (prior art)

The first one is shown in FIG. 1 (PRIOR ART) and provides for the use of at least one rod-crank system with vertical movement, or a pneumatic cylinder with vertical stem, or a vertical movement system controlled by a linear motor, which pushes the clips of wipes folded on each other downwards, transferring them to a descender consisting of a plane with straight and parallel horizontal bars, spaced apart, which lowers supporting the stack being formed. When the stack is complete, a comb with vertical teeth enters shifting horizontally between the bars of the support plane, expelling the same stack from the production line, which is moved laterally on a belt that transfers it to a packaging station.

Figure 2:
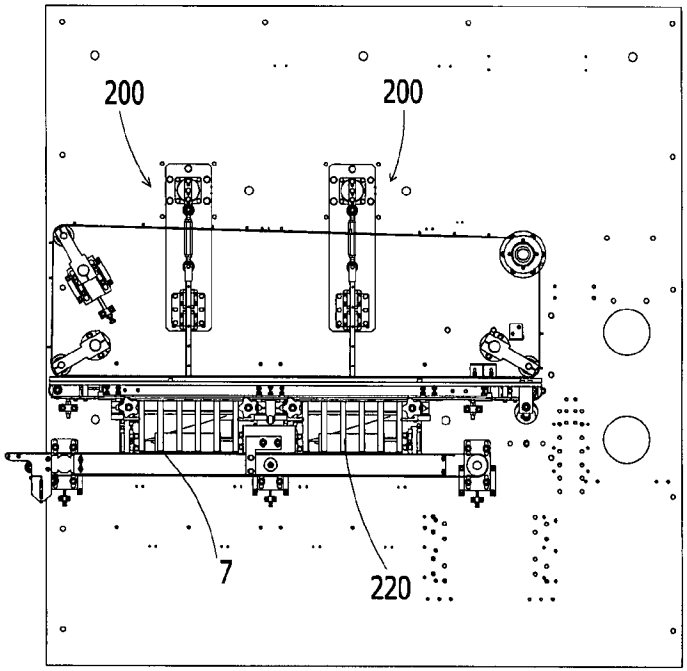
Fig. 2 (prior art)

The second one is shown in FIG. 2 (PRIOR ART) and provides for the use of at least one rod-crank system with vertical movement, or a pneumatic cylinder with vertical stem, or a vertical movement system controlled by a linear motor, which pushes the clips of wipes folded on each other downwards, transferring them to a descender consisting of a series of planes with straight and parallel horizontal bars, spaced apart, which operate one at a time lowering and supporting the stack being formed between a containment cage (not shown) consisting of two parallel sequences of vertical bars that enter the spaces between the straight and parallel bars of the descending plane. When the stack is complete, the plane withdraws quickly, dropping the stack on an underlying belt that transfers it to a packaging station, whereas another plane exits quickly on top to receive the new clips of wipes.

The first type of batching and expelling devices therefore provides for the stacks of wipes to be transferred from the main production line to a diverted conveyor line, parallel to the main one, but laterally shifted relative thereto.

The second type of batching and expelling devices, on the other hand, provides for the stacks of wipes to be laid on a diverted conveyor line that constitutes the continuation of the main production line, without being laterally shifted relative thereto.

To increase the productivity of the stack forming lines, two or more counting and expelling devices, of the same type of batching system, are already put in a series to one another but the physical productivity limit is defined by the subsequent packaging step, that normally cannot manage more than 100-150 stacks a minute, whereas each grouping device may also process 100-120 stacks a minute, for a joint productivity of 200-240 stacks a minute.

Therefore, in order to keep the productivity of the stack forming line high, downstream of the counting and expelling devices there is arranged a system for dividing the single stack line into two parallel lines, through diverters of the known type, so as to feed two packaging machines with lower production speed.

Such systems for obtaining the counting, batching and expulsion of the wipe stacks, whatever type of the two known ones they belong to, have some limits or drawbacks:

- they transfer the stacks to a single conveyor line, either it belongs to an axis parallel to the main one, laterally shifted relative thereto, or it belongs to the continuation of the same main axis of the production line, or shifted vertically, forcing to use a further system for dividing the single wipe stack line into at least two parallel lines for preventing the productivity limit represented by the packaging machines;
- they do not allow producing stacks with a number of different wipe groups, since the group counting must be the same for all types of counting and expulsion devices, since the stacks cannot be diverted and managed individually;
- they force to waste considerable spaces both in width and in length for the use of counting and expulsion devices in a series, and furtherly in length for the use of diverters for dividing the single line of stacks into two parallel lines;
- they increase the risk of machine stoppage due to possible jamming of the diverters;
- they introduce high costs for both the machine and the containment structure of the same machine.

The invention aims at overcoming these limits by providing an improved device for batching and expelling stacks consisting of a predetermined number of clips of disposable wipes from a main production line, which:

- directly separates, during the count and the expulsion, the groups of wipes into two parallel lines arranged on different levels while using grouping devices of the same type;
- allows producing wipe stacks with a different number of wipes;
- eliminates the possibility of machine downtime due to the diverter unit as it eliminates the use thereof;
- reduces the spaces required for the machine, limiting the construction and space arrangement costs for seating the same machine.

Such aims are achieved by an improved system for batching and expelling first and second stacks consisting of a predetermined number of clips of disposable wipes from a main production line including at least a first grouping device that counts the clips and transfers the stacks from the main production line to a first diverted conveyor line parallel to the main one, characterized in that it includes at least a second grouping device, placed downstream from the first one, which counts the clips and transfers the stacks from the main production line to a second diverted conveyor line, parallel to the main one, in which said first diverted conveyor line develops at a level lower than said second diverted conveyor line.

Advantageously, said first grouping device is equal to said second grouping device.

Advantageously, said first and second stacks may comprise an equal or different number of clips of wipes.

According to a first aspect of the invention, said first and second grouping device for counting and expelling stacks from the production line consisting of predetermined clips of disposable wipes, which transfer the stacks from a diverted conveyor line parallel to the main one, are preferably of the type comprising vertically movable means arranged for cooperating with a descender consisting of a plane with straight and parallel horizontal bars that are spaced apart, vertically movable and provided with a comb having horizontally movable vertical teeth.

According to a further aspect of the invention, said first and second grouping device for counting and expelling clips from the production line consisting of predetermined groups of disposable wipes, which transfer the stacks from a diverted conveyor line parallel to the main one, are preferably of the type comprising vertically movable means arranged for cooperating with a descender consisting of a series of planes with straight and parallel horizontal bars that are spaced apart, that operate one at a time lowering and withdrawing at travel end, supporting the stack being formed between a containment cage consisting of two parallel sequences of vertical bars that enter the spaces between the rectilinear and parallel bars of the descending plane.

The invention has several advantages:

- the division of the single line of wipe groups is obtained, coming from the main line into two independent lines arranged along parallel lines directly into the counting and expulsion zone of the disposable wipe stacks, increasing the production speed and the productivity itself;
- the use of horizontal diverters is prevented for dividing the single main line of stacks into two diverted parallel lines, reducing the space and eliminating problems of space occupied;
- it is possible to use grouping devices of the same type, reducing costs for spares and for maintenance works;
- to prevent unbalance of the stacks along the conveyor lines, it is advantageously possible to also use only grouping devices of the type provided with the containment cage for supporting the group of folded wipes during the stack forming step and vertical transfer of the same from the main to the diverted line through descender means;
- finally, it is possible to allocate the single grouping devices arranged in a series with each other but independently programmable, different stack productions, consisting of two or more different numbers of groups of wipes, to be used for two or more different packaging units.

The advantages of the invention shall appear more clearly from the following description of a preferred embodiment, made by way of a non-limiting example and with the help of the figures, wherein:

FIGS. 1 and 2 show a perspective view of two examples of grouping devices made according to the prior art and usable in the system according to the invention.

Figure 7:
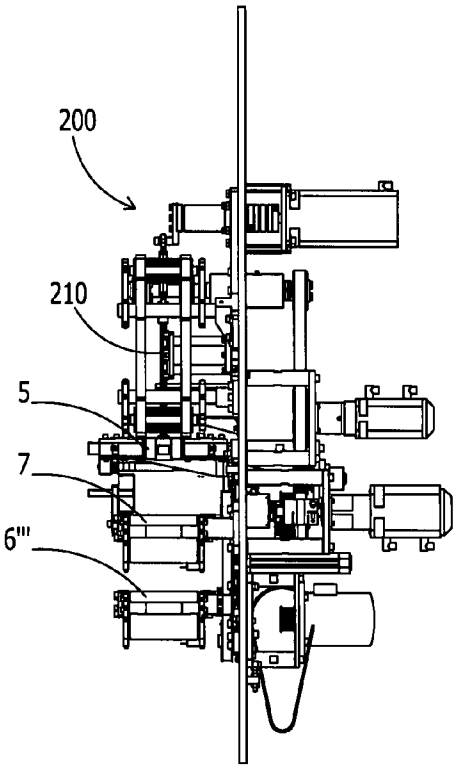
Figure 3:
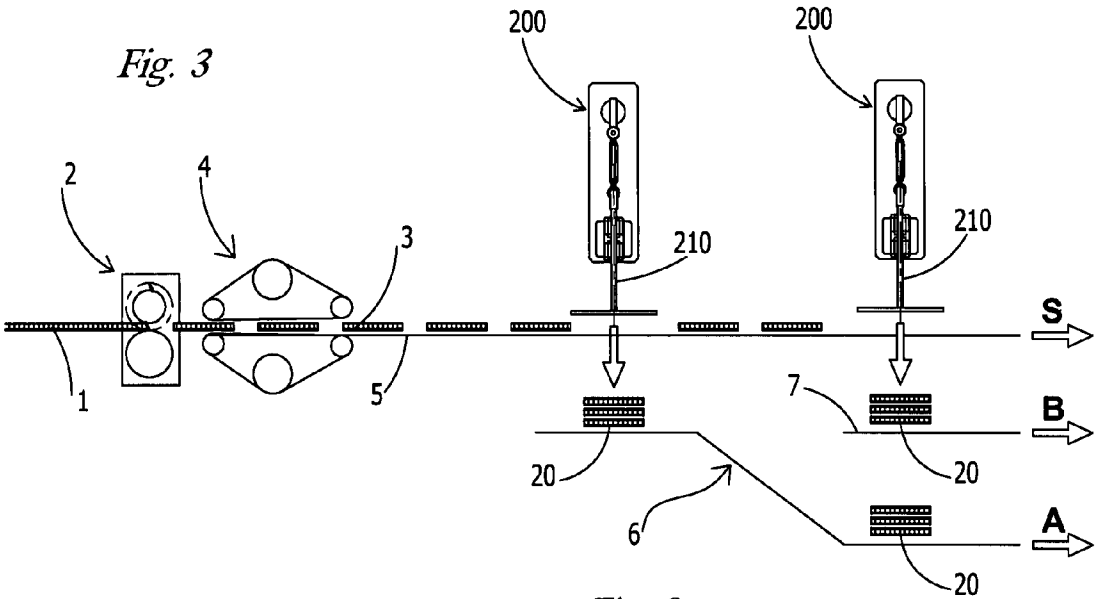
Figure 8:
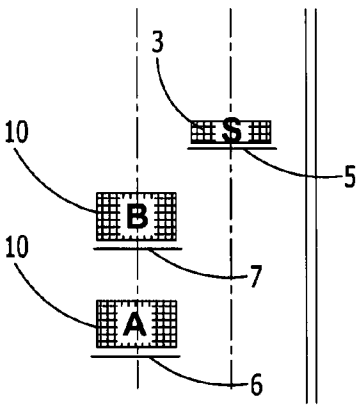
Figure 4:
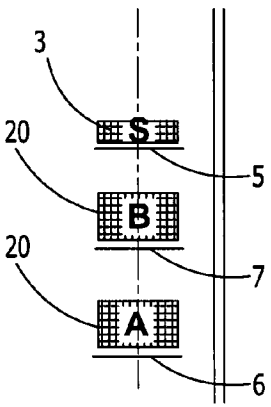
Figure 5:
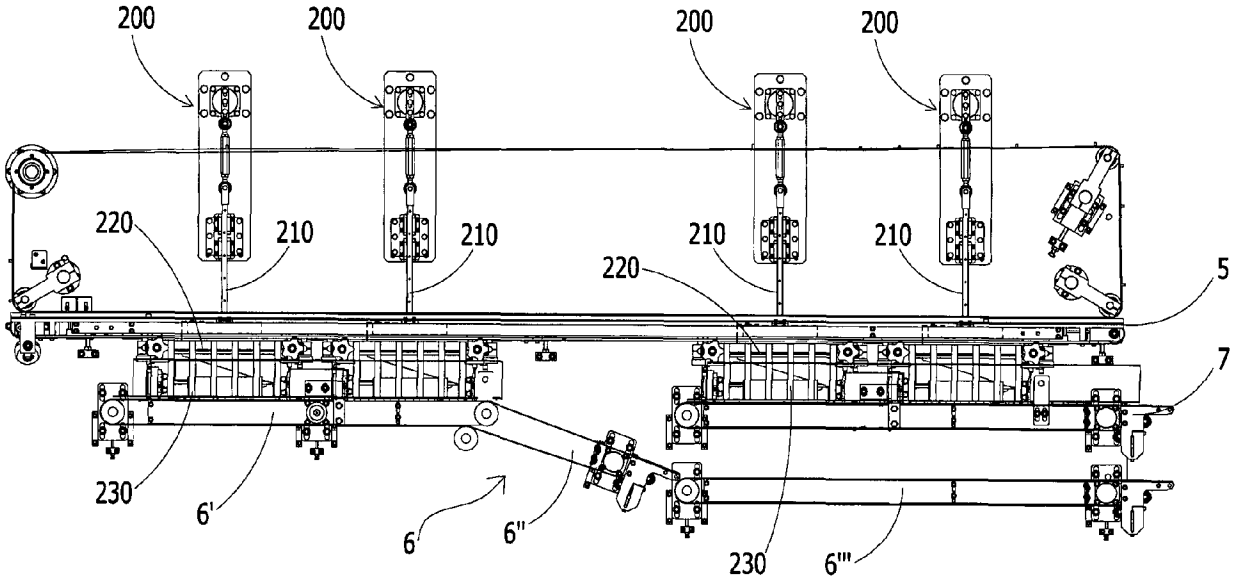
Figure 6:
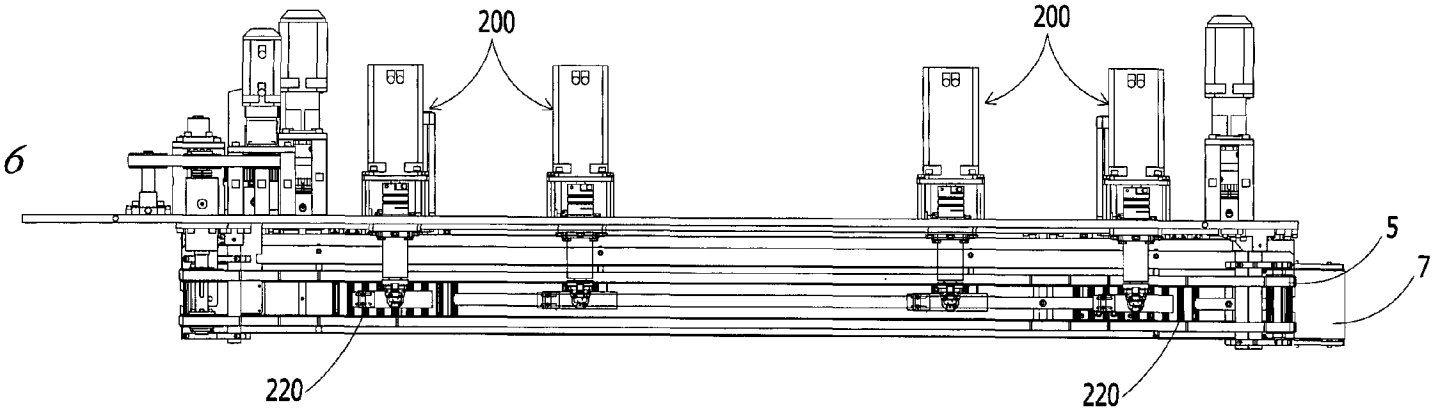

FIGS. 3 and 4 respectively show a front and a side view of a preferred schematization of a system for batching and expelling stacks consisting of a predetermined number of clips of disposable wipes from a main production line according to the invention;

FIGS. 5-7 respectively show a front, a top and a side view of a system for batching and expelling stacks consisting of a predetermined number of clips of disposable wipes from a main production line according to the invention and the diagram of FIGS. 3 and 4;

FIG. 8 shows a schematic side view of a possible embodiment of the system according to the invention.

With reference to FIGS. 3 and 4, there is shown a diagram of a line for producing and packaging disposable wipes into stacks which substantially comprises an initial zone for making a multilayer tape 1 (or bar) obtained by overlapping and folding various strips of paper; an intermediate zone comprising a bar cutting device 2 so as to make clips of wipes 3 folded on each other, which are fed by a pushing and separation device 4 on a conveyor belt 5 which represents the main conveyor line S; a zone for counting and expelling clips 3 for making stacks 20 consisting of a predetermined number of clips of wipes and a final zone for packaging said stacks (not shown).

In particular, the zone for counting and expelling the clips of wipes comprises, in the case shown, only two grouping devices 200 placed in a series, a conveyor belt 5, of the type with dual parallel belt, arranged on the same forming level of clips 3, and two belts 6 and 7 for transferring stacks 20, which represent the two diverted conveyor lines A and B.

Belt 6 starts at the first one of the grouping devices 200 and is placed underneath the conveyor belt 5, but along the same direction line.

Belt 6 runs by the entire length of the first grouping device at a first height, whereas it lowers furtherly at a second height, at the second grouping device, allowing the passage of stacks 20 under belt 7.

Belt 7 starts at the second one of grouping devices 200, it is placed at a lower level than that of conveyor belt 5 but along the same direction line S and continues substantially at the same height, along its own feeding direction B.

The level of conveyor belt 5 coincides with that of output of scraps or of the single clips 3 not associated to one another for forming any composite stack.

The grouping devices 200 comprise vertically movable means 210 arranged for pushing clips of wipes 3 from an upper level S to a lower level A or B.

With reference to FIGS. 5-7 there is shown a system according to the invention provided with a plurality of grouping devices 200 for counting and expelling stacks consisting of predetermined clips of wipes from the production line.

Said devices transfer the stacks from a main production line S to two different diverted conveyor lines A and B arranged at lower levels than the main conveyor belt 5.

Said vertically movable means 210 are preferably of the type comprising a rod-crank system with vertical movement, or a pneumatic cylinder with vertical stem, or a vertical movement system controlled by a linear motor, and they cooperate with descenders consisting of a series of planes with straight and parallel horizontal bars 220, spaced apart, which operate one at a time lowering and supporting the stack being formed between a containment cage consisting of two parallel sequences of vertical bars 230 that enter the spaces between the straight and parallel bars of the descending plane. When the stacks are complete, the planes withdraw quickly, dropping the stacks on underlying belts 6, 7 that transfer them to a packaging station, whereas other bar planes 220 exit quickly on top to receive the new clip of wipes.

Belt 6 forms the first diverted conveyor line A and comprises three different portions 6'-6"-6'", arranged in a sequence. The first portion 6' is arranged at the two first grouping devices 200 and develops to a first height, lower than that of belt 5 intended for the main line S and substantially equal to that of belt 7 intended for representing the second diverted conveyor line B; the second portion 6" is inclined so as to join portion 6' to portion 6'"; portion 6'" is arranged at the remaining grouping devices 200, at a second height, furtherly lower than that of belt 7, representing the final height of the diverted line A.

According to possible embodiment, the portion of belt 6" arranged inclined may be replaced with other descending means of the known type, traditionally suitable for jointing sliding devices arranged at different heights.

According to a further embodiment, said grouping devices 200 may be replaced with grouping devices 100 arranged for transferring the stacks from the main line S to diverted conveyor lines A and B arranged at levels at lower heights than the height of the main line S and shifted laterally relative thereto.

Said grouping devices 100 comprise vertically movable means 110 preferably of the type comprising a rod-crank system with vertical movement, or a pneumatic cylinder with vertical stem, or a vertical movement system controlled by a linear motor, and they cooperate with descenders consisting of a series of a plane with straight and parallel horizontal bars 120, spaced apart, which lower supporting the stacks being formed wherein, when the stacks are complete, a comb 130 with vertical teeth inserts shifting horizontally between the bars of the support plane, expelling from the production line the same stacks which are moved laterally on the belts that transfer them to a packaging line.

FIG. 8 schematically shows a system that provides for the use of at least two grouping devices 100, arranged so that belts 6 and 7 of the diverted lines A and B are both laterally shifted, although at different heights relative to each other and to belt 5 of the main line S.

The system operation is as follows

The bar 1 obtained by overlapping and folding various strips of paper is cut by a cutting device 2 so as to form clips 3 of wipes folded on each other that advance along a main line S by means of a pushing and separation device 4 on a conveyor belt 5 up to a zone for counting clips 3 and expelling stacks 20, consisting of a predetermined number of clips 3, then proceeding towards an end packaging line of the known type of said stacks 20.

The same counting and expulsion zone comprises at least two grouping devices 200 arranged for managing stacks 20, consisting of a predetermined number of clips of wipes 3, and for transferring them to diverted belts 6, 7 which respectively start at the first and the second grouping device 200 and develop along staggered levels and lower than that of the conveyor belt 5, but placed on the same direction line relative thereto.

With such configuration of the counting and expulsion line, the stacks 20 formed by the grouping devices 200 arranged in a series are on two aligned diverted conveyor lines A and B, but arranged at two different levels, represented by belts 6 and 7, ready to be fed to two packaging machines.

Of course, stacks 20 may consist of a same number of clips 3 or of a different number, for example for being fed to packaging machines arranged for creating two different types of products.

A further packaging possibility results from clips 3 managed individually without being grouped, which continue the path along the main line S on the conveyor belt 5 up to a packaging zone to create a further type of product.

As is clear to the man skilled in the art, the invention was described referring only by way of an example to a counting and expulsion zone of the clips of wipes comprising at least two grouping devices 100 or 200, but more in general it is applicable to the packaging of any product obtained by an in line processing and with the use of a plurality of grouping devices 100 or 200, also with construction features differing from those described and illustrated, but with the same system for managing the product position, always achieving the advantages described above.

The invention claimed is:

1. Improved system for batching and expelling first and second stacks (10, 20) consisting of a predetermined number of clips (3) of disposable wipes from a main production line (S, 5), comprising at least a first grouping device (100, 200) that counts the clips (3) and transfers the stacks (10, 20) from the main production line (S, 5) to a first diverted conveyor line (A, 6) parallel to that main line, characterized in that it includes at least a second grouping device (100, 200), placed downstream from the first one, which counts the clips (3) and transfers the stacks (10, 20) from the main production line (S, 5) to a second diverted conveyor line (B, 7), parallel to the main line (S, 5), in which said first diverted conveyor line (A, 6) develops at a level lower than said second diverted conveyor line (B, 7).

2. Improved system according to claim 1, characterized in that said at least first grouping device (100, 200) is identical to said at least second grouping device (100, 200).

3. Improved system according to claim 1, characterized in that said first diverted conveyor line (A) comprises a belt (6) consisting of two portions (6', 6''') placed at different levels from each other.

4. Improved system according to claim 3, characterized in that said belt (6) comprises a further portion (6") arranged for connecting the said two portions (6', 6''').

5. Improved system according to claim 1, characterized in that said first and second stacks (10, 20) comprise an equal number of clips (3) of disposable wipes.

6. Improved system according to claim 1, characterized in that said first stacks (10) comprise a number of clips (3) of disposable wipes different from said second stacks (20).

7. Improved system according to claim 1, characterized in that said grouping device (100) comprises vertically movable means (110) arranged for cooperating with a descender consisting of a plane with straight and parallel horizontal bars (120) that are spaced apart, said descender being vertically movable and provided with a horizontally movable comb (130) having vertical teeth.

8. Improved system according to claim 1, characterized in that said grouping device (200) comprises vertically movable means (210) arranged for cooperating with a descender consisting of a series of planes with straight and parallel horizontal bars (220) that are spaced apart, which work one at a time lowering and withdrawing at the end of stroke, supporting the package being formed in a containment cage consisting of two parallel sequences of vertical bars (230) that enter the spaces between the straight and parallel bars of the descending plane.

9. Machine for the production and packaging of stacks consisting of a predetermined number of clips of disposable wipes, characterized in that it comprises an improved system for batching and expelling first and second stacks (10, 20), consisting of a predetermined number of clips (3) of disposable wipes from a main production line, according to claim 1.

10. Machine for the production and packaging of stacks consisting of a predetermined number of clips of disposable wipes, characterized in that it comprises an improved system for batching and expelling first and second stacks (10, 20), consisting of a predetermined number of clips (3) of disposable wipes from a main production line, according to claim 2.

11. Machine for the production and packaging of stacks consisting of a predetermined number of clips of disposable wipes, characterized in that it comprises an improved system for batching and expelling first and second stacks (10, 20), consisting of a predetermined number of clips (3) of disposable wipes from a main production line, according to claim 3.

12. Machine for the production and packaging of stacks consisting of a predetermined number of clips of disposable wipes, characterized in that it comprises an improved system for batching and expelling first and second stacks (10, 20), consisting of a predetermined number of clips (3) of disposable wipes from a main production line, according to claim 4.

13. Machine for the production and packaging of stacks consisting of a predetermined number of clips of disposable wipes, characterized in that it comprises an improved system for batching and expelling first and second stacks (10, 20), consisting of a predetermined number of clips (3) of disposable wipes from a main production line, according to claim 5.

14. Machine for the production and packaging of stacks consisting of a predetermined number of clips of disposable wipes, characterized in that it comprises an improved system for batching and expelling first and second stacks (10, 20), consisting of a predetermined number of clips (3) of disposable wipes from a main production line, according to claim 6.

15. Machine for the production and packaging of stacks consisting of a predetermined number of clips of disposable wipes, characterized in that it comprises an improved system for batching and expelling first and second stacks (10, 20), consisting of a predetermined number of clips (3) of disposable wipes from a main production line, according to claim 7.

16. Machine for the production and packaging of stacks consisting of a predetermined number of clips of disposable wipes, characterized in that it comprises an improved system for batching and expelling first and second stacks (10, 20), consisting of a predetermined number of clips (3) of disposable wipes from a main production line, according to claim 8.

* * * * *